US005623846A

United States Patent [19]

Brewer, Jr.

[11] Patent Number: 5,623,846

[45] Date of Patent: Apr. 29, 1997

[54] DEVICE FOR STRAIGHTENING A FRAME OF AN AUTOMOBILE

[76] Inventor: Clarence R. Brewer, Jr., Rte. 3, Country Club Estates, Central City, Ky. 42330

[21]* Appl. No.: 346,019

[22] Filed: Nov. 29, 1994

Related U.S. Application Data

[63] Continuation-in-part of Ser. No. 159,121, Nov. 30, 1993, abandoned.

[51] Int. Cl.[6] ..... B21D 1/12

[52] U.S. Cl. ..... 72/305; 72/705

[58] Field of Search ..... 72/305, 457, 705

[56] References Cited

U.S. PATENT DOCUMENTS 4,289,016 9/1981 Hare ..... 72/705

5,189,899 3/1993 Hsu ..... 72/705

*Primary Examiner*—Lowell A. Larson

*Attorney, Agent, or Firm*—Wheat, Camoriano, Smith & Beres, PLC

[57] ABSTRACT

An integrated platform/clamping structure for use in combination with a frame straightening system; the structure including multiple clamp assemblies slidably attached to the platform of the system for lateral movement relative to the platform. The clamp assemblies can be moved independently of one another until they are located underneath the automobile pinchweld. The clamp assemblies also have a mechanism (in the preferred embodiment, a vertically aligned piston/cylinder system) which raise each clamp relative to the platform. Once the clamp touches the pinchweld, means (in the preferred embodiment, a second, horizontally aligned piston/cylinder system) are provided to automatically fix the jaws of the clamp over the pinchweld and lock. The system also has linear measurement gauges underneath the platform and made a part of the system, with means to raise the gauges into an operable location adjacent the undercarriage of the car.

14 Claims, 15 Drawing Sheets

DEVICE FOR STRAIGHTENING A FRAME OF AN AUTOMOBILE

This application is a continuation-in-part of my earlier application entitled "Device for Straightening a Frame of an Automobile", filed on Nov. 30, 1993, U.S. patent application Ser. No. 08/159,121, now abandoned.

BACKGROUND OF THE INVENTION

The present invention relates generally to a device used in accident remediation and more particularly to a device used to straighten the frame or unibody of a car damaged in an accident.

It will be appreciated by those skilled in the art that during collisions, automobiles are often times damaged to the point that the frames or unibodies are bent out of alignment. Most modern automobile construction does not include a traditional "frame" as such, but rather, the so called "unibody" construction is employed wherein the body panels of the vehicle are pinchwelded in multiple locations to a perimeter plate to form the perimeter support structure of the vehicle. The pinchweld of unibody construction creates a reinforced rim about the outside of the vehicle. In this application, the terms "frame" and "pinchweld" are used substantially interchangeably to designate the perimeter support structure of a vehicle which requires alignment after being bent or warped as a result of the vehicle being involved in a collision or the like. The invention of the instant application works equally well with vehicles of frame construction and unibody construction as well as most variations thereof.

When the frame or unibody of an automobile is bent, the repair of the collision damage cannot proceed effectively because the replacement body parts will not align. Further, even if the repair could be completed, the automobile would not "track" properly; that is to say that the rear wheel of the vehicle would not be aligned in the same imaginary track as the front wheel when the vehicle is traveling along a straight path. The failure to "track" will cause the vehicle to pull to one side of the road or the other, causing unnecessary wear to the tires of the vehicle. Proper alignment will cause the automobile to track properly and facilitate the correct mating of body parts that are being replaced as a part of the body shop repair of the collision damage. The prior devices for straightening the frame of a vehicle all generally operate in the same manner. First, the automobile is driven or pulled upon a platform. A platform is generally considered to be necessary in order to elevate the vehicle above the support surface or floor (although other systems are available which do not employ a platform) so that the mechanic can get to the undercarriage of the vehicle and instrumentation can be located adjacent the frame for measurements used in checking correction of alignment. After the automobile is on the platform, the frame of the automobile must be fixed in a stationary position relative to the platform so that force (generally in a lateral direction) can be applied to the frame at various points around the perimeter of the frame to pull or bend the frame back into alignment. The lateral force is applied to the frame by attaching a hook or clamp to the frame; the hook is connected via a chain or the like to a hydraulic (or motor driven) pulling mechanism and by activation of the mechanism, the hook pulls the frame into alignment.

Heretofore, the process of fixing the frame of the automobile to the platform has been by multiple clamping devices. In most cases the prior art clamping devices have not been a part of the platform itself, and must be imported from a remote location by hand and manually attached both to the platform and to the frame of the vehicle. To create access to the undercarriage of the vehicle, most platforms have an open core. Also, it is convenient if the platform can be tilted so that the vehicle can be driven or pulled onto the platform. The loading of the vehicle onto the platform and the open core of the platform are the primary reasons that the clamps have not been a part of the platform itself. Specifically, the frame or the pinchweld of most vehicles is substantially in-line with the front and back wheels of the vehicle. For that reason, it has been assumed historically that if the clamps were in place on the platform, they would interfere with the loading of the vehicle onto the platform.

Thus, when using prior art systems, it has traditionally been necessary that a clamp be retrieved from a wall board or other nearby storage facility and placed underneath the car so that the clamp can be attached to the pinchweld on the unibody of the automobile. This procedure is generally repeated three more times until four clamps are clamped into place at intervals about the perimeter of the vehicle, thereby fixing it to the platform so that the alignment process can begin.

The prior art clamps tend to weigh forty to sixty pounds and are very cumbersome to carry. Unfortunately, most of these clamps also are of a given height so that if the frame is bent vertically (in the "Y" direction), as opposed to laterally (in the "X" or "Z" direction), the clearance between at least some portion of the frame and the platform may be less than the height of the clamp. In these cases, a jack must be used to raise the automobile sufficiently so that the clamp may be put in place. The jack may also function to bend the frame in the "Y" direction so that the frame will be aligned in all directions when the process is completed. Even in those cases where the frame is not bent in the "Y" direction, because most modem cars are built so low to the ground, they must be raised to perform the frame straightening procedure. Further, raising the vehicle at its frame relieves pressure from the suspension system of the vehicle and makes the frame straightening process more efficient.

In the prior art, the process is to first raise the vehicle with a jack mechanism or the like and then bolt the clamps to the platform. After the clamps are affixed to the platform of the frame straightening device, they are then attached to the frame of the vehicle. The clamp jaws are then tightened by bolts to hold the car. Most prior art clamping devices have five to ten bolts per device for a total of twenty to forty bolts per vehicle to tighten in order to secure the clamps to the car. This is a very wearing process. Each of these bolts is tightened and loosened ten to twenty times per week, in most cases by a technician using an air wrench. Therefore, the bolts and nuts are damaged and wear out over a short period of time.

In the prior art systems, the measuring tools, including those gauges measuring the underside of the car for alignment, are generally not a part of the platform system itself, but are placed in a different location on a rack and brought to the automobile after the automobile is in position for the frame straightening process to begin. All of these prior art systems are cumbersome, time consuming in operation and subject to extraordinary wear and attendant high maintenance cost. They also are ineffective because they must be manually raised to the car's underbody or the car lowered to the measuring system, all of which takes time and is labor intensive. As a practical matter, if the system is automatic, the body shop mechanic will use it, but if the system takes too much time to assemble or operate, because the mechanic is paid generally on a job (as opposed to a time) basis, he may simply use a tape measurer or tram gauge to perform the alignment, function both of which are less accurate and may result in the customer's car remaining mis-aligned when the job is finished.

Thus, while there have been several attempts to provide frame straightening devices for automobiles involved in frame-altering collisions, unfortunately, all have the limitations discussed in the previous paragraphs.

What is needed, then, is a frame straightening system which integrates holding clamps with the platform of the system so that they may be moved in relationship to a car that has been placed on the platform of the system and can be readily shifted between a retracted position and a clamp position to engage the frame, normally the pinchweld, of the car. The desired device should also provide a system for clamping the clamp on the pinchweld that does not require the user to actually install the clamp manually. The desired device should also have the ability to raise the vehicle to a proper working height and align the frame in the vertical or "Y" direction. Preferably, the desired device would provide for linear measurement gauges underneath the car and made a part of the system with means to raise the gauges into an operable location adjacent the undercarriage of the car so that they do not have to be brought to the platform from a wall unit or other storage facility. The device should also provide boltless fastening of the clamp and clamp jaws. Such a device is presently lacking in the prior art.

SUMMARY OF THE INVENTION

The present invention discloses an integrated platform/clamping structure for use in combination with a frame straightening system; the structure including multiple clamp assemblies slidably attached to the platform of the system for lateral movement relative to the platform. The clamp assemblies can be moved independently of one another until they are located underneath the automobile pinchweld. The clamp assemblies also have a mechanism (in the preferred embodiment, a vertically aligned piston/cylinder system) which raises each clamp relative to the platform. Once the clamp touches the pinchweld, means (in the preferred embodiment, a second, horizontally aligned piston/cylinder system) are provided to automatically fix the jaws of the clamp over the pinchweld and lock. The system also has linear measurement gauges underneath the platform and made a part of the system, with means to raise the gauges into an operable location adjacent the undercarriage of the car.

Accordingly, one object of the present invention is to provide an integrated platform/clamping structure for use in combination with a frame straightening system.

Another object of the present invention is to provide an integrated platform/clamping structure for use in combination with a frame straightening system wherein the clamps are slidably attached to the platform so that they may be moved in relationship to a car that has been placed on the platform; enabling the clamps to easily engage the pinchweld.

Another object of the present invention is to provide a structure of the type described which is attached to the automobile without nuts and bolts which will maintain its operable position without the necessity of pins, clamps or the like being inserted or connected after the system is activated to the operable position.

Another object of the present invention is to provide a structure of the type described wherein the clamp that is to be attached to the pinchweld is integrated with the platform of the structure in such a manner that the system does not require the user to actually move and/or place the clamp personally.

Another object of the present invention is to provide a structure of the type described having a system for raising the automobile relative to the platform to relieve pressure from the suspension system which will assist in the alignment of the frame of the automobile placed on the structure, to provide clearance between the platform and the undercarriage of the automobile to provide working space for the mechanic and to assist in the alignment of the automobile in the vertical or "Y" direction.

Another object of the present invention is to provide a device having linear measurement gauges underneath the top surface of the platform and integral with the system, with means provided to raise the gauges into a working location beneath the car so that they do not have to be brought to the platform from a wall unit or other remote storage facility.

DESCRIPTION OF THE PREFERRED EMBODIMENT

Figure 1:
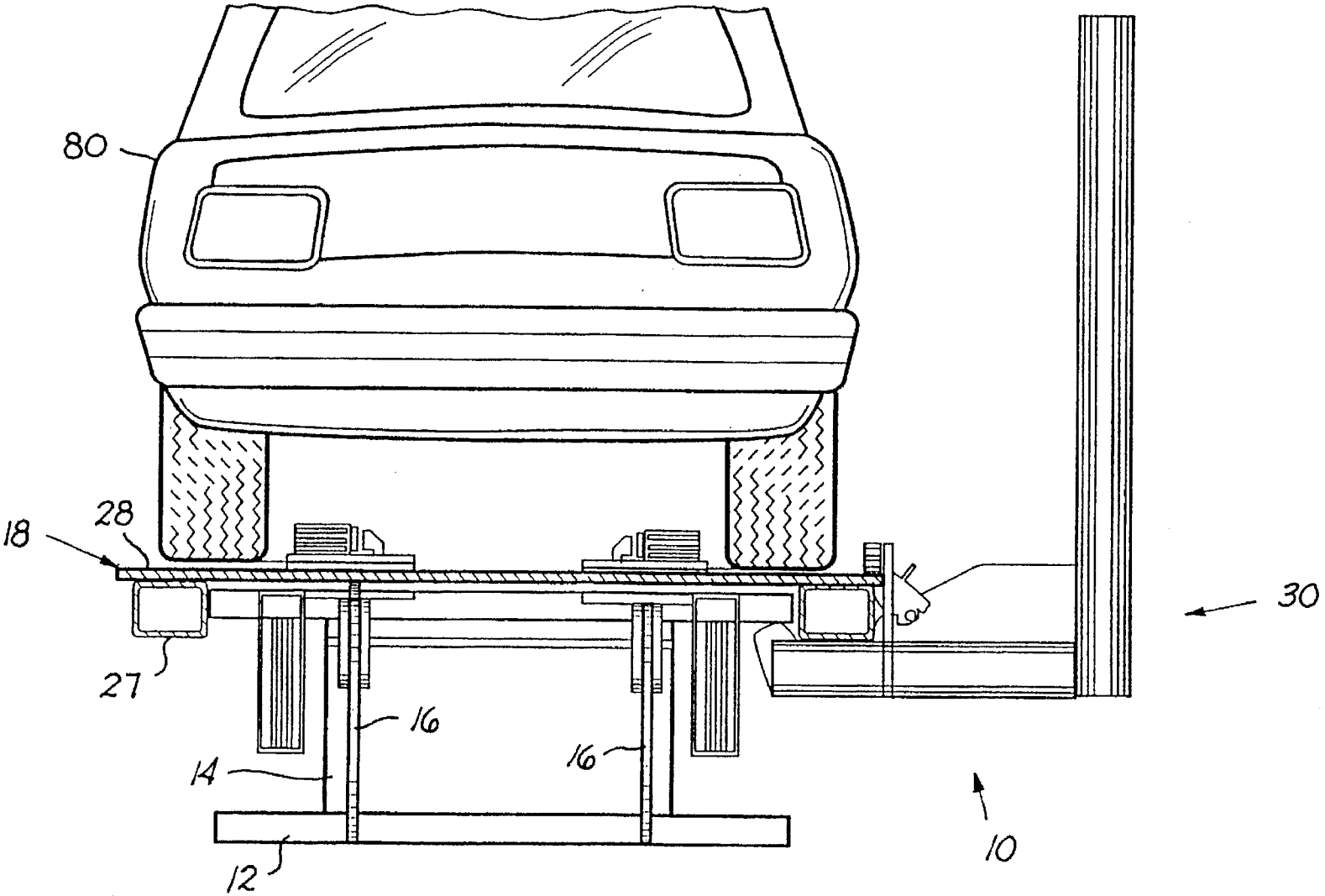
FIG. 1 is a view of the frame straightening device of the present invention.

Referring now to FIG. 1, there is shown generally at 10 the device of the present invention for use in the procedure of straightening the frame of a car. More specifically, the device 10 is the combination of a platform on which an automobile is placed for the frame straightening procedure, a clamping structure which clamps the frame of the automobile and holds it fixedly on the platform, and a pulling mechanism which rotates about the outside perimeter of the platform and can be located strategically at points about the perimeter of the automobile for pulling the frame of the automobile in order to properly align the frame. The device 10 will be described in conjunction with the drawings as the drawings are orientated into this application, specifically with reference to the front and back of the device and the right and left of the device as viewed from its rear. However, these terms are relative and used only for reference in connection with the drawings as illustrated in the application and are not to be considered limiting in the orientation of the device itself.

The device 10 has as its most elementary structural members front arms 14 (see FIGS. 2, 3, 4 and 6) and rear legs 16. A stabilizing base 12 (FIGS. 1 and 6) is placed on the ground or workshop floor and extends between and connects the front arms 14. A similar stabilizing base 12' may be provided between rear legs 16 (see base 12' in FIG. 7). Platform 18 sits on and is fixedly connected to arms 14 as can be best seen in FIG. 6. Platform 18 also sits on legs 16, although legs 16 are not rigidly connected to the platform 18. As can be seen from FIG. 7, a cross beam 15 extends between opposing sides of the platform 18, and legs 16 are rotatably connected to the cross beam 15 at connection 17 (see FIGS. 4, 4A, 6 and 7).

Locking arm 19 has a notch 21 (see FIG. 4A) which ratchets onto base 12' (see FIG. 4A) and locks the platform in place when the rear of the platform is raised to the horizontal position. The platform is raised and lowered by expansion/contraction of the push piston 23 which extends between the arms 16 and the platform. Push piston 23 is hydraulically activated by fluid pressure forced against the piston when a pump is activated by a switch and lowered when the fluid pressure is removed from the piston by reversing the process.

To lower the rear of the platform 18 in order to load a vehicle onto it, the push piston 23 is extended slightly in order to be able to disengage the wedge 21 of locking arm 19 from the brace 12'. Once disengaged, the locking arm 19 can be rotated out of the locked position. At that point, the pressure can be relieved from the push piston 23 allowing the push piston to collapse. As the push piston collapses, the wheel 25 at the end of the legs 16 rolls rearwardly of the system along the surface on which the system is sitting, thereby lowering the rear of the system for loading and unloading a vehicle onto it.

Figure 2:
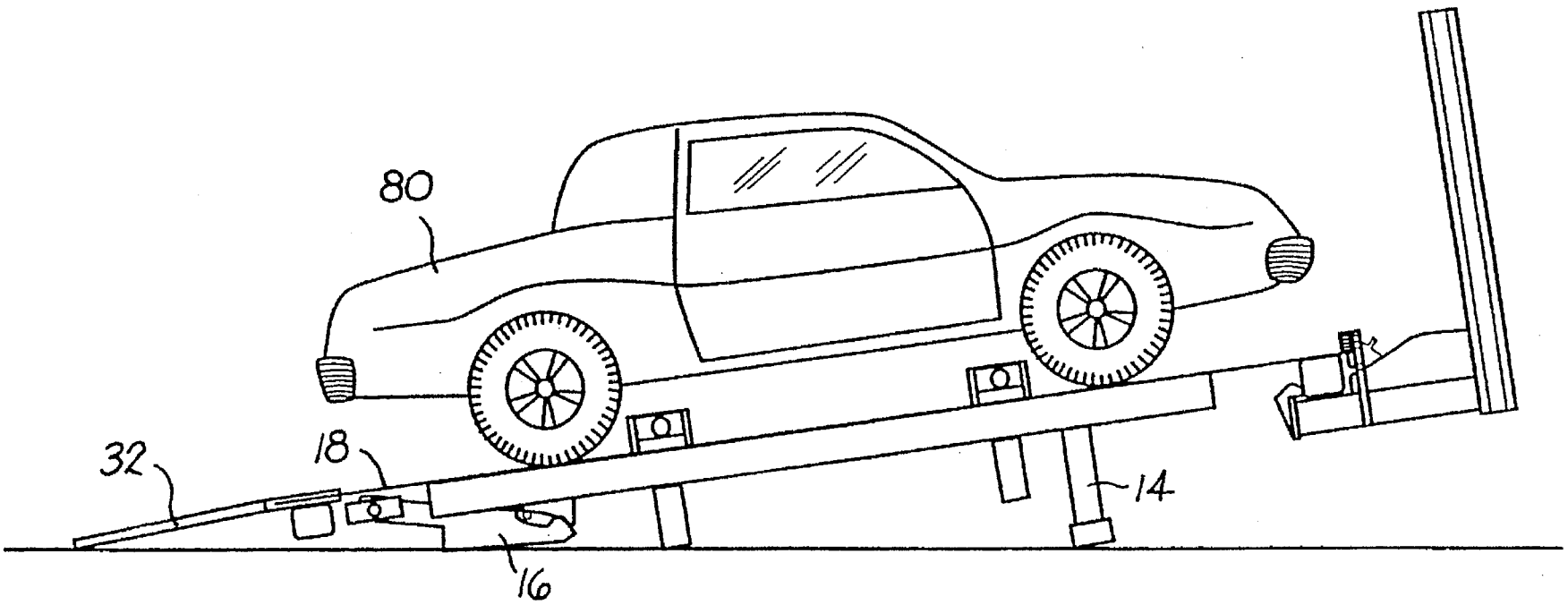
FIG. 2 is a side view of the frame straightening device of the present invention in tilted position.
Figure 3:
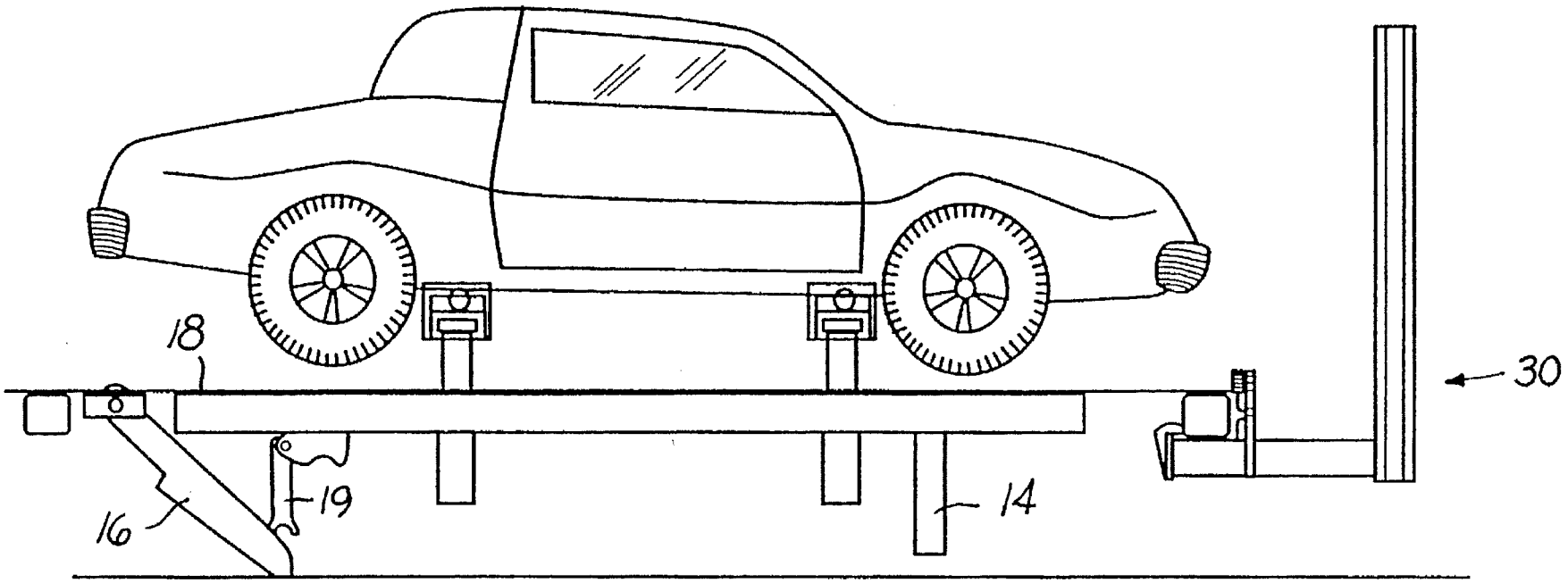
FIG. 3 is still another side view of the frame straightening device of the present invention in the leveled position.

An earlier version of the mechanism for raising and lowering the platform is shown schematically in FIGS. 2 and 3. As can be seen in FIGS. 2 and 3, the legs 16 can be rotated clockwise to the position shown in FIG. 3 to raise the rear of the platform. Locking arm 19 will then lock the rear legs 16 in place for stability for the system. Further clockwise rotation of the leg 16 will allow the locking arm to be released; then the pressure can be relieved from the piston driving the legs 16 so as to allow them to rotate counterclockwise, thereby lowering the back of the platform so that a vehicle can be loaded on and unloaded from it.

There are a number of known mechanisms for raising and lowering a platform to facilitate loading and unloading the vehicle. Several such systems are manufactured by Brewco 360° Collision Repair Systems of Central City Kentucky, and brochures and repair manuals for such systems are readily available from Brewco as well as a variety of other sources.

Figure 1A:
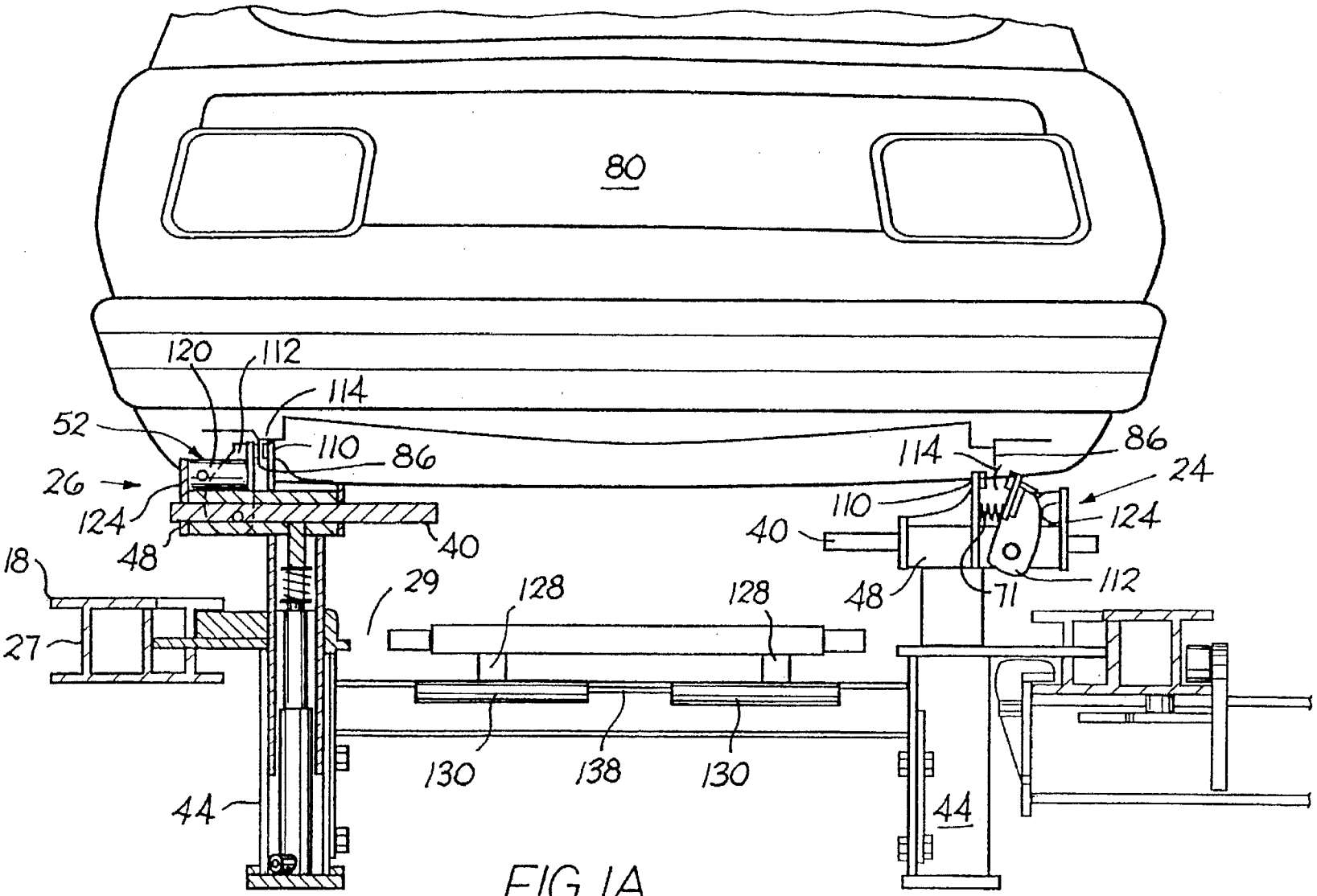
FIG. 1A is a rear view of the frame straightening device of the present invention showing an automobile in place (the tires have been removed from the drawing) and opposing clamping mechanisms positioned in two relative positions.
Figure 6:
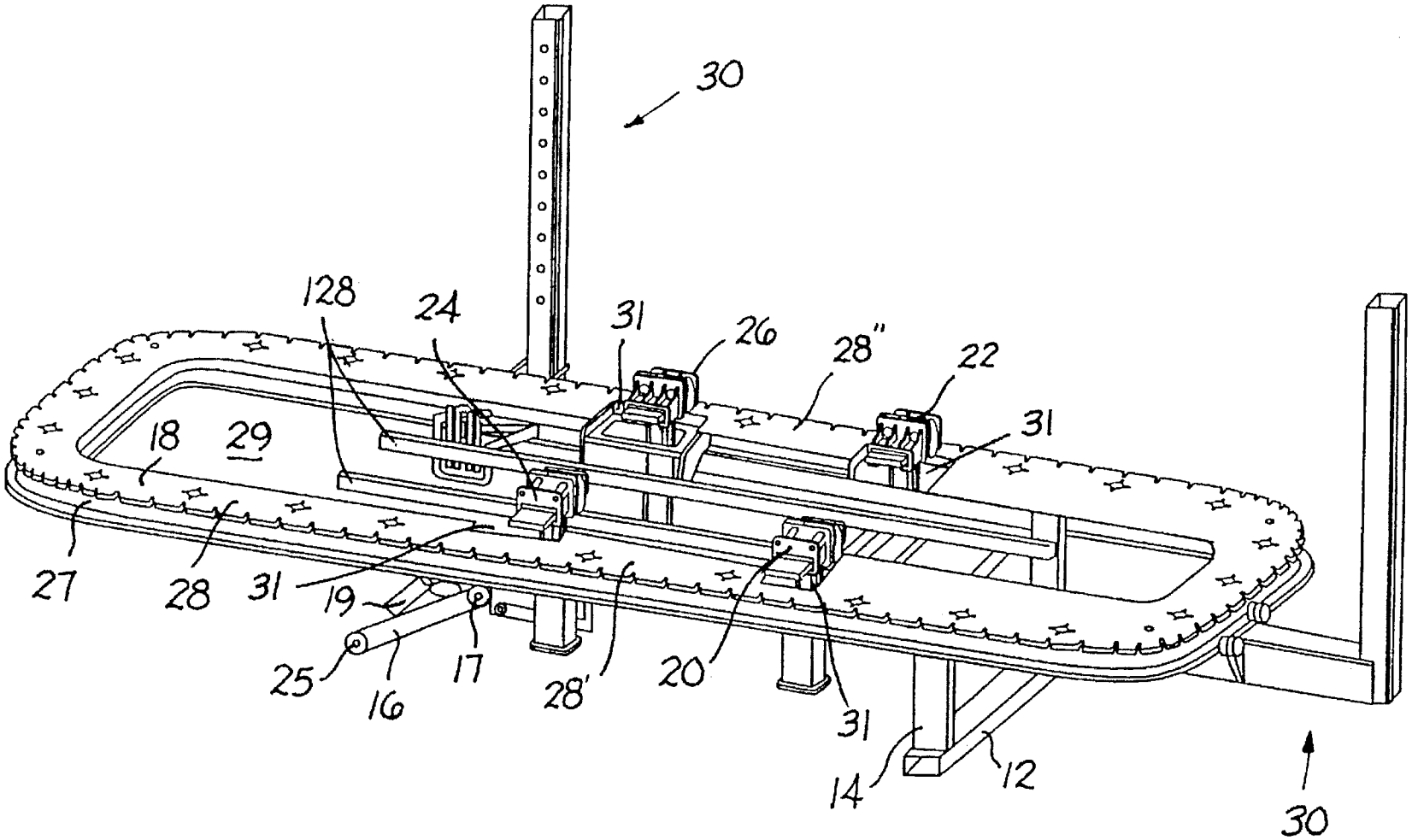
FIG. 6 is a perspective view of the platform of the present invention.

The platform 18, as can be best seen from FIGS. 1, 1*a* and 6, includes a box beam 27 about its outer perimeter and a support surface 28 on which the vehicle sits during the alignment procedure. The box beam 27 provides stability and strength needed for the structure because pressures up to 20,000 lbs. force are applied to the vehicle during the frame straightening process and that force is transmitted to the platform 18 via the clamp assemblies hereinafter described, and is countered by the strength of the box beam 27.

Figure 7:
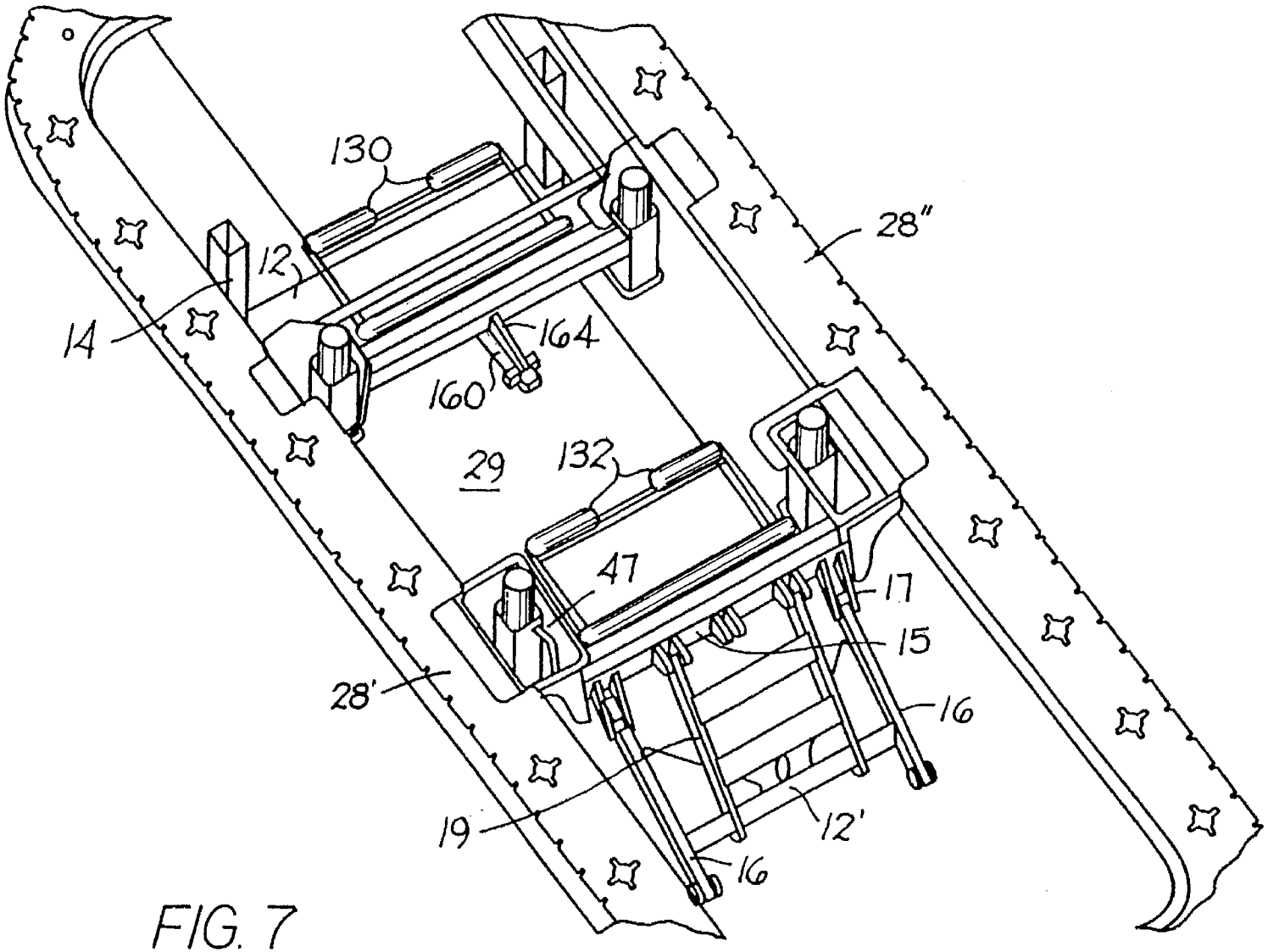
FIG. 7 is another perspective view of the platform of the present invention showing the support structure on which the alignment instruments and gauges rest.

The shape of the platform is essentially that of an elongated rectangle, as can be seen from FIGS. 6 and 7, with an open center. The shape of the platform 18 is dictated by several factors; first, the automobile 80 which sits on the platform has an elongated rectangular shape for its frame or the pinchweld of the body of the vehicle, and the wheels of the vehicle are arranged in the shape of an elongated rectangle when the vehicle is resting on the platform. The open center 29 of the platform 18 is necessary to enable a mechanic to get to the undercarriage of the vehicle when the vehicle is sitting on the platform and to enable the mechanic to place measuring instruments adjacent the under carriage of the vehicle to measure for proper alignment.

As can be seen from FIGS. 1, 3, 4 and 6, the device 10 of the present invention includes pull towers 30 which are mounted to the outer perimeter of the platform in such a manner that they can travel about the outer perimeter of the platform. Alignment requires that the pull towers 30 be moveable to locate them at various points about the perimeter of the platform where pulling pressure must be applied to the vehicle mounted on the platform in order to pull the frame or unibody of the vehicle into alignment. The vehicle that sits on the platform is held in position by the clamp assemblies of the system, and the pulling force applied to the frame of the vehicle through pull tower 30 will pull the frame or unibody of the vehicle back into alignment. Once again, the structure and mounting of pull towers 30 is well known and a variety of such structures exist in the market place, including those frame alignment systems sold by Brewco 360° Collision Repair Systems of Central City, Kentucky, under various BREWCO trademarks, including the BREWCO Elite, the BREWCO Body Builder 360, BREWCO Executive 360 and others. Such products have been on the market for many years and the operation and structure of such devices is well known to those skilled in the art. Pull towers 30 generally include a chain, a hook on one end of the chain, the chain connected at its other end to the pulling tower and ultimately to a power source such as an electric motor or the like which can be activated to apply pulling force to the vehicle through the transmission of that force via the chain and hook which is attached to the frame of the vehicle.

Turning now to the improvements that Applicant has developed for systems of the type just described, attention is again directed to FIGS. 1 and 1A. As can be seen from FIG. 1A, the location of the pinchweld 86 which runs about the perimeter of the vehicle 80 is, in that portion of the pinchweld running along the side of the vehicle from front to back, substantially aligned between the front and rear wheels of the vehicle. When the platform is tilted as shown in FIG. 2 in order to load a vehicle onto the platform, the vehicle 80 will be driven (or pulled) onto a ramp 32 which feeds the vehicle onto the elongated side portions 28' and 28" of the support surface 28 (see FIGS. 6 and 7).

The device of the present invention has four clamp assemblies 20, 22, 24, and 26, which are described herein for purposes of convenience, in relation to and as shown in the various figures of the drawings, as the right front, left front, right rear and left rear clamp assemblies, respectively. The exact location and comparative location of the clamp assemblies 20, 22, 24 and 26 is not controlled or limited by those descriptions; what is significant is that the clamp assemblies cannot be in the path of travel of the vehicle onto the platform 18 over the side portions 28' and 28" when the vehicle is being loaded onto the platform, but they need to be in the path of travel of the wheels over the side portions 28', 28" for clamping onto the pinchweld 86 of the unibody structure of the vehicle for carrying out the alignment procedure. Therefore, the clamp assemblies 20, et al. are normally stored at some remote location adjacent the platform 18 and mounted to the platform only after the vehicle 80 has been loaded onto the platform 18. There have been some attempts to provide clamp assemblies mounted on alignment platforms, but those attempts have not been adequately automated to make the loading and unloading of the vehicle and the placement and removal of the clamp assembly sufficiently convenient for the mechanic. Applicant's invention provides an automatic, hydraulically controlled system which provides tremendous time savings over prior art devices.

Figure 1B:
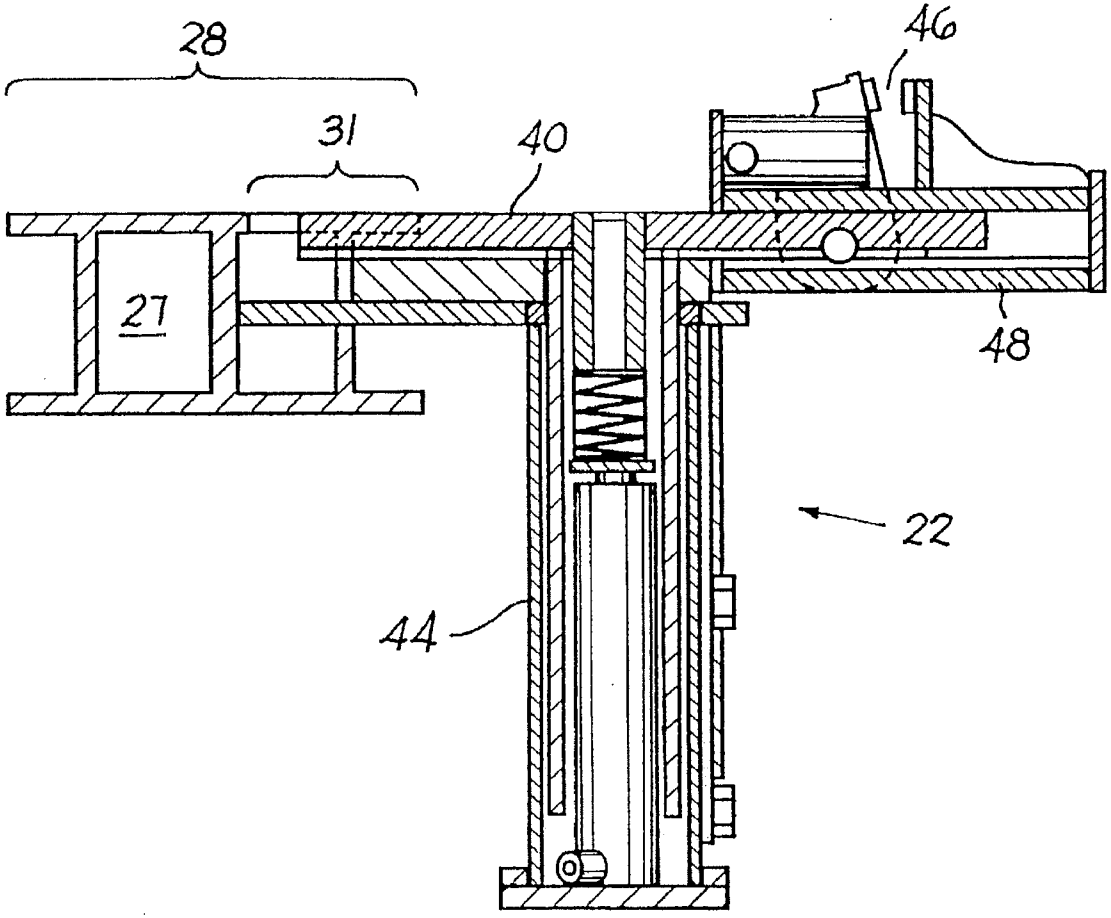
FIG. 1B is cross sectional view of one of the clamp assemblies of the invention.

For convenience, the locations of the clamp assemblies 20, 22, 24, and 26 are referred to herein as in the "at rest" position when the clamp assemblies are located in the open center 29 of the platform 18 and out of the path of the travel of the vehicle onto the platform 18 over the side portions 28', 28". The "at rest" position of the clamp assemblies is best seen in FIGS. 1 and 1B. In FIG. 1B, a cross-section view of a side portion 28' is shown which extends over box beam 27. Notches 31 (FIG. 1B and FIG. 6), are formed in the side portions 28', 28" to receive the clamp assemblies 20, 22, 24 and 26. As can be seen from FIG. 1B, when a clamp assembly 22 is in the "at rest" position, the top of one element of the clamp assembly fills (or partially fills) the notch 31 so that a car being loaded onto the platform 18 can pass over the notch by traversing over the top of the assembly 22 and not fall into the cavity created by the formation of the notch 31 in the side portions 28', 28". Also as can be seen in FIG. 1B, when the clamp assemblies 20 et al. are in the at rest position, the clamp 46 and bracket 48 (as are more fully described hereinafter) are retracted into the open center 29 of the platform 18.

In addition to the "at rest" position as is shown in FIG. 1B, the clamp assemblies 20, et al. have a "clamping" position as is shown in the position of the left rear clamp assembly 26 in FIG. 1A. An infinite number of positions is possible with the device of the present invention between the two extremes of the "at rest" position of FIG. 1B and the clamping position shown for clamp assembly 26 in FIG. 1A.

The clamp assemblies of the present invention can all be moved in the "Y" direction or vertically and in the "X" direction (when viewed from the back of the system), and in the preferred embodiment, the two clamp assemblies 24/26 at the rear of the platform 18 can be moved in the "Z" direction or from front to back. For convenience, in describing the movement of the clamp assemblies, the "Y" direction may occasionally be referred to as up and down or vertical movement, the "X" directional movement of the clamp assemblies may be referred to as lateral or side to side movements, and the movement of the clamp assemblies in the "Z" direction may be referred to as front to back movement, with the understanding that the front of the device is as shown to the fight of the illustration in FIG. 6, the back of the device 10 is to the left of the illustration in FIG. 6 and the sides of the device 10 are to the left and fight of the drawings illustrated in the drawings of FIGS. 1 and 1A.

Figure 4:
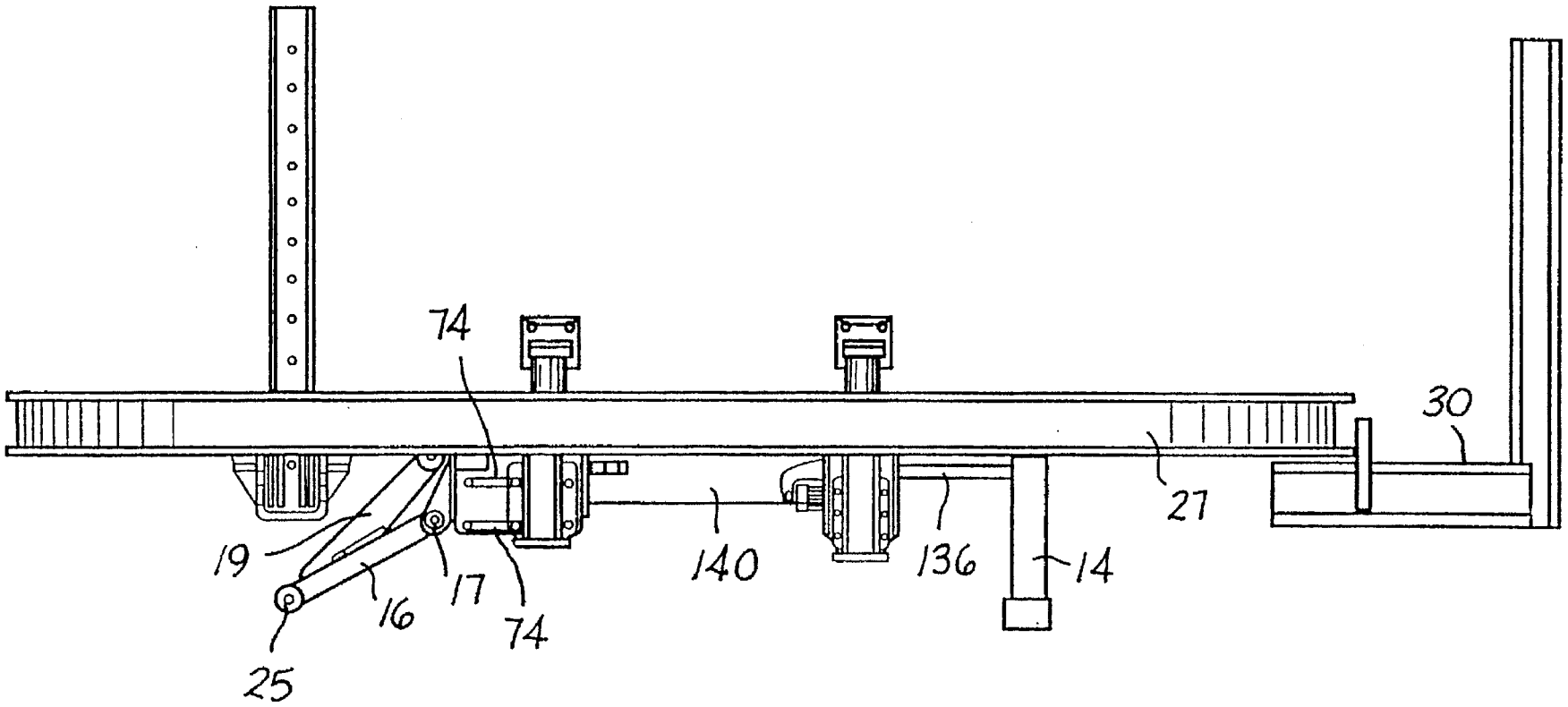
FIG. 4 is a side view of the frame straightening device with an alternative rear lifting mechanism and the frame straightening arms shown in greater detail.
Figure 4A:
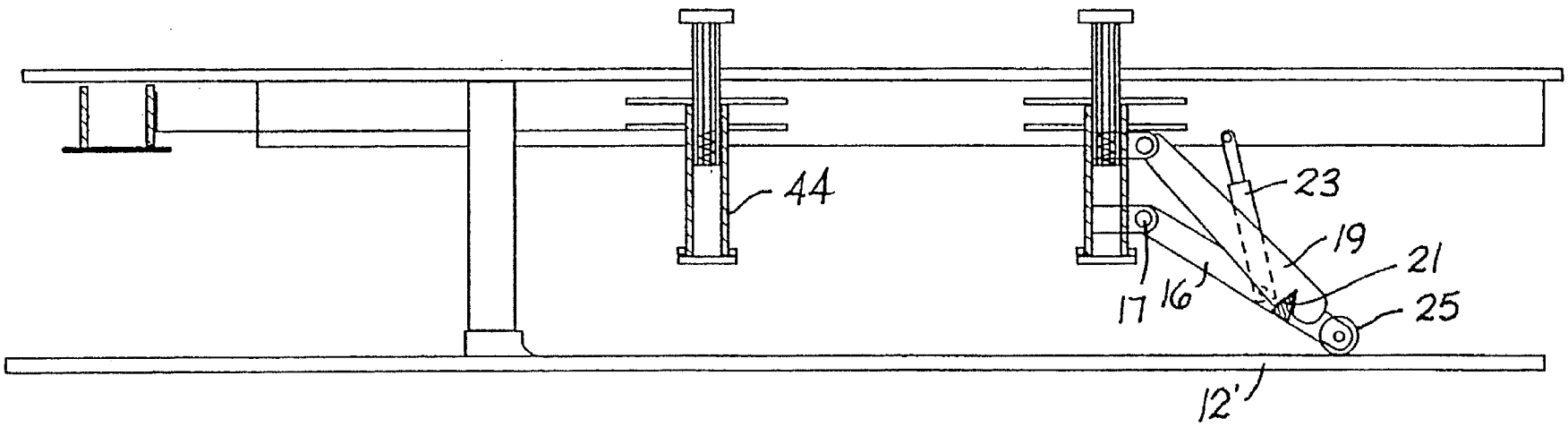
FIG. 4A is a side view of the alternative embodiment of the device as shown in FIG. 4 when viewed from the opposite side of the device.
Figure 4B:
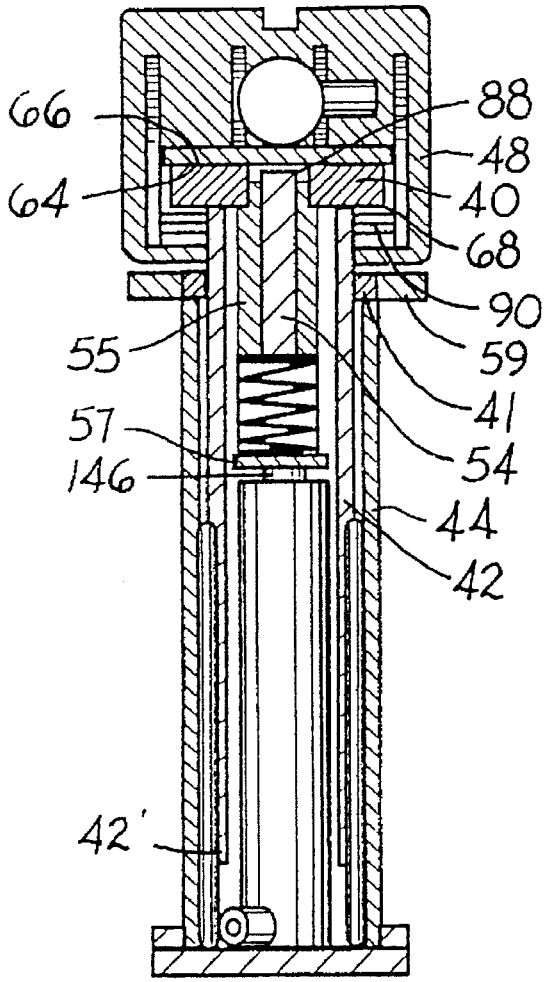
FIG. 4B is a side view of the clamp assembly of the present invention.
Figure 4C:
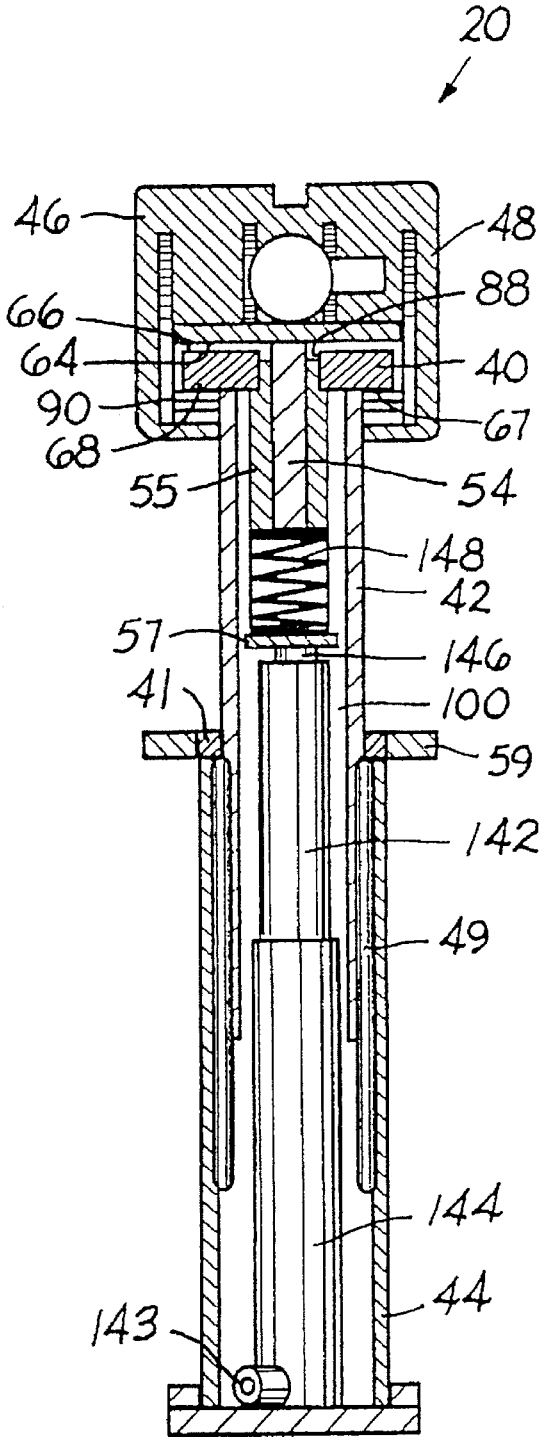
FIG. 4C is another side view of the clamp assembly of the present invention with the structure raised and locked into position.

The various movements of the clamp assemblies 20, et al. can be best understood when consideration is given to FIGS. 1B, 4B, 4C, 4D, and 4E. FIG. 5 best illustrates the structure which enables the rear most clamp assemblies to move in the "Z" direction or front to back.

Figure 4D:
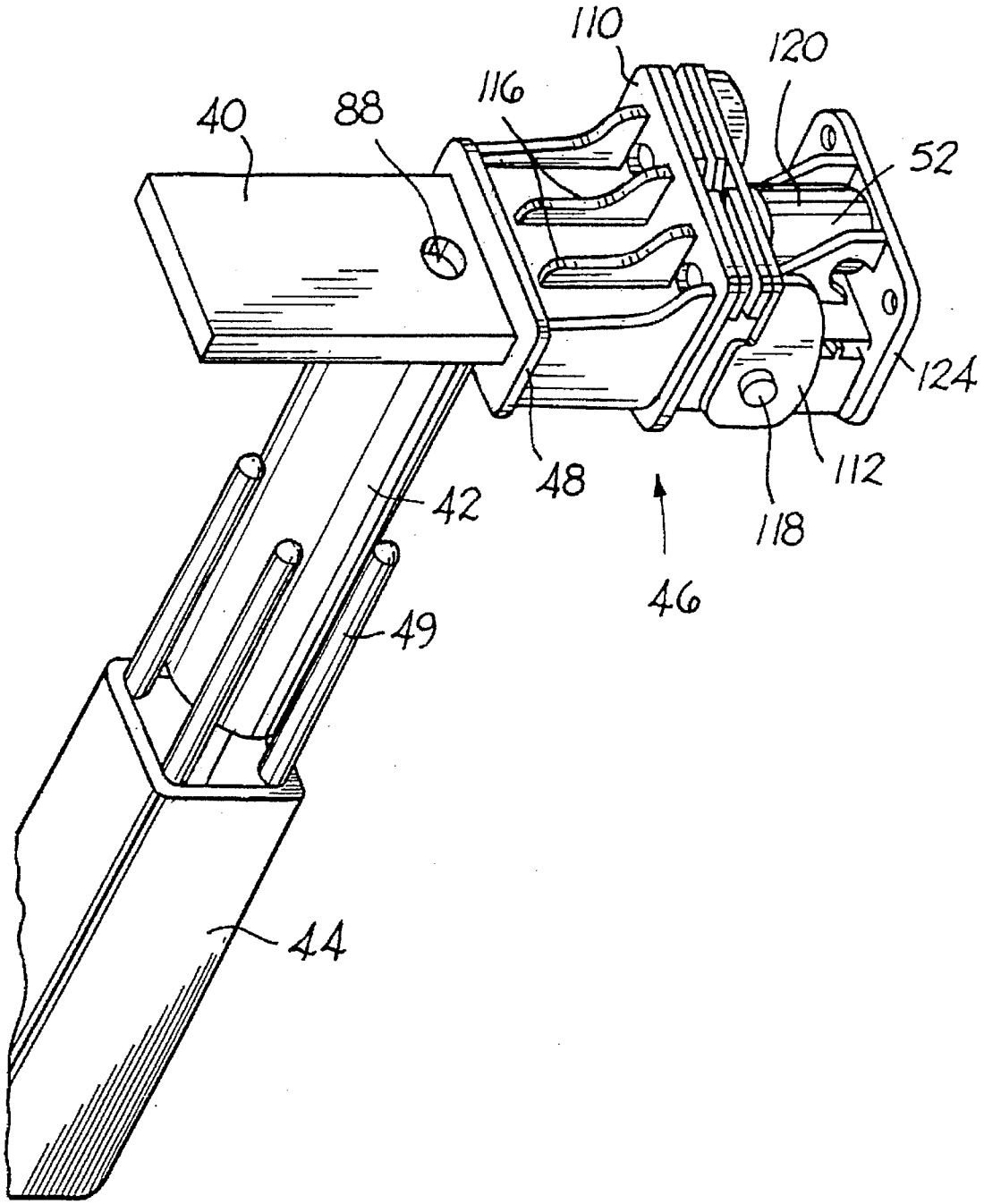
FIG. 4D is a perspective view of the clamp assembly of the present invention viewed from the left rear of the system.
Figure 4F:
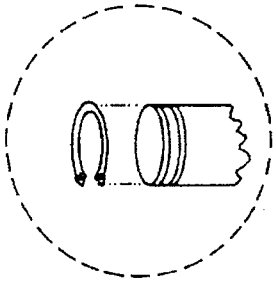
FIGS. 4E and F are an exploded view of the clamp assembly of the present invention showing greater detail of the assembly itself.
Figure 4E:
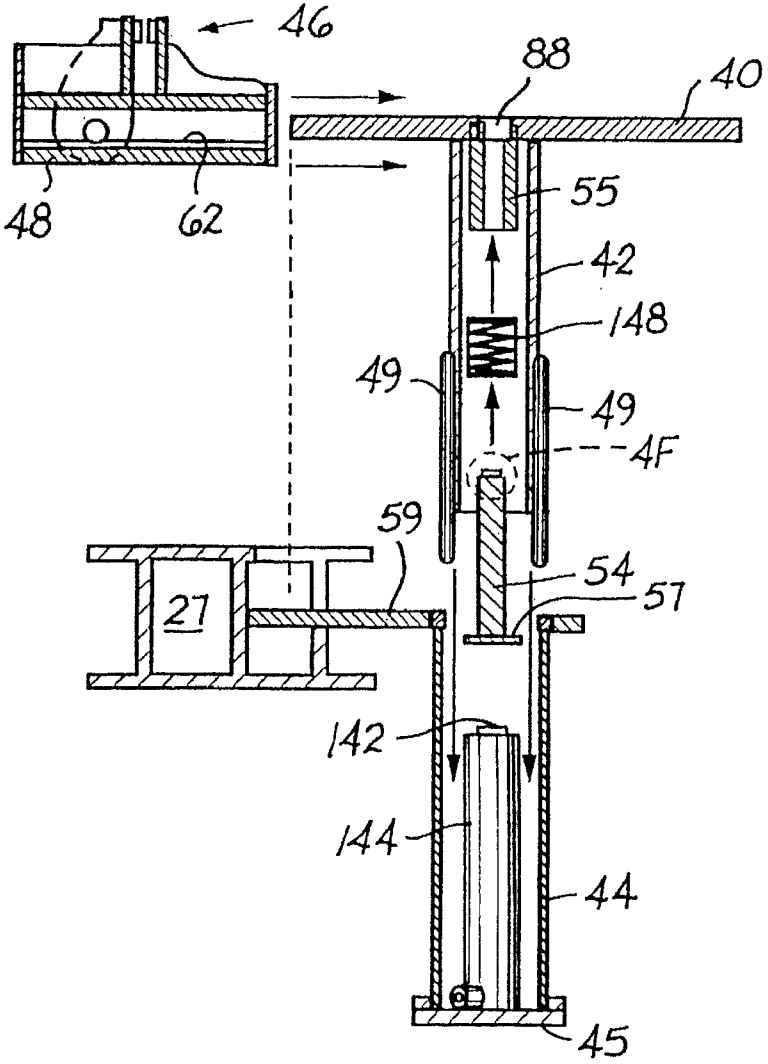
Figure 5:
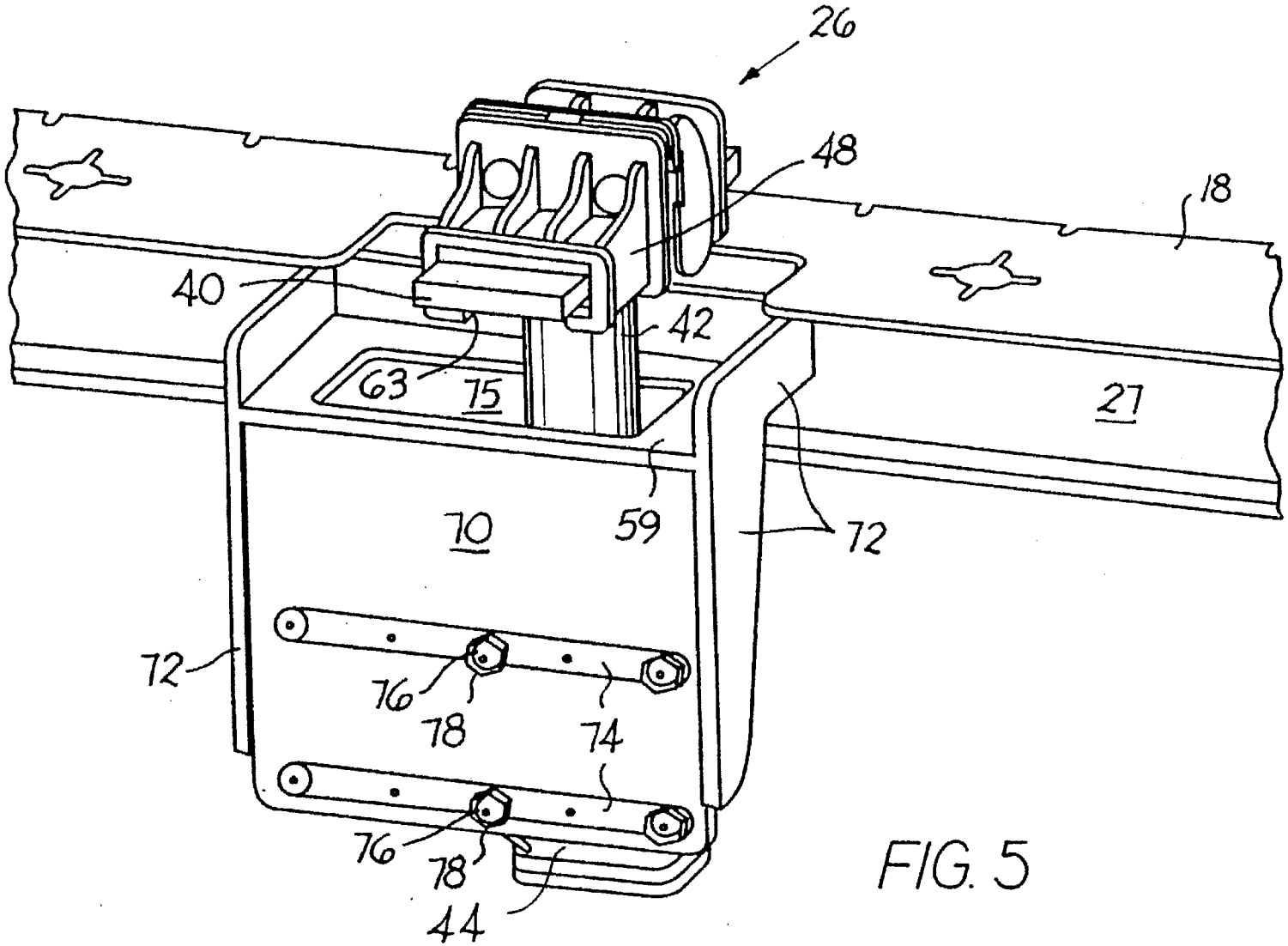
FIG. 5 is a perspective view of the mounting bracket of one of the rear clamp assemblies of the present invention.

FIG. 4D gives a general perspective view of the clamp assemblies of the present invention. The clamp assemblies 20, et al. include vertical cylinders 44 generally square in cross section and hollow throughout their length. The vertical cylinders 44 are closed at their lower most extremity by bottom 45 which is fixedly attached to the vertical cylinder 44. The top of the vertical cylinder 44 is fixedly attached to the platform 18 at box beam 27 in one of two arrangements. In one arrangement as can be seen in FIG. 4E, an offset plate 59 is welded or otherwise attached to box beam 27 with the plate extending laterally into the open chamber 29 of the platform 18. The top of the vertical cylinder 44 is fixed to the offset plate 59 and flush with the offset plate. The square opening in the top of the vertical cylinder 44 is in registry with a circular opening in the offset plate 59.

The second arrangement for attaching vertical cylinder 44 to platform 18 is best seen in FIG. 5. There, clamp assembly 26, one of the rear clamp assemblies 24/26 which are moveable in the "Z" direction, is shown. In the arrangement shown in FIG. 5, the vertical cylinder 44 is attached to a plate 70 which is attached, in turn to offset plate 59. Offset plate 59 is attached to box beam 27 and reinforced and stabilized by struts 72. A pair of elongated slots 74, extending generally in the "Z" direction are provided in the plate 70, and wings panels 47 (see FIG. 7) are formed in or welded to each side of the vertical cylinder 44 with bolts 76 connecting through the wings 47 and through the slots 74 to clamp the vertical cylinder 44 to the plate 70. Nuts 78 screw onto the ends of the bolts 76 extending through the slots 74 and can be tightened onto the bolts to clamp the vertical cylinder to the plate 70. Also, elongated opening 75 is formed in each offset plate 59 and extends generally in the "Z" direction with piston 42 protruding in the "Y" direction through the elongated opening 75. By this attachment arrangement, the nuts 78 on the ends of bolts 76 can be loosened if there is a need to move the rear clamp assemblies 24/26 in the "Z" direction to change the length of spacing of the rear clamp assemblies 24/26 in relationship to the front clamp assemblies 20/22 to accommodate the differing length of chassis of different models of vehicles, the frames of which are being straightened on the system 10 of the present invention. Of course, if additional adjustment capacity is needed, the front clamp assemblies could also be mounted with the described second attachment arrangement. Automation of the change of the position of the rear assemblies in the "Z" direction is not necessary or essential because most cars are of sufficiently equivalent length in chassis that "Z" direction adjustment is only required occasionally.

Regardless of the attachment arrangement of the vertical cylinder 44 to the box beam 27, piston 42 (see FIG. 4D) is circular in cross section and fits within and mates with the midpoint of each of the four sides of the cylinder 44. Alignment rods 49 are welded to the piston 42 and are positioned, sized and shaped to fit within the cavities in the comers of the piston 44. The alignment rods 49 also function as "stops" to limit the extent of lift or vertical movement of the piston 42 relative to the cylinder 44 as can be seen in FIG. 4C. Thus, the alignment rods 49 will engage the underside of a circular cup 41 connected to the top of the vertical cylinder 44 so that the piston 42 will not rise above the level shown in FIG. 4C. The alignment rods also limit the downward movement of the piston 42 as can be seen in FIG. 4B because the alignment rods extend below the bottom of the piston 42, 42' and engage the bottom 45 of the vertical cylinder 44 when the clamp assemblies 20 et. al are in the at rest position. Primarily however, the alignment rods 49 provide a limited friction alignment mechanism to prevent the piston 42 from binding in the vertical cylinder 44 during up and down movement of the clamp assemblies 20, et al. because these components of the system are subject to extreme forces and stress which might otherwise cause them to bind and prevent easy movement in the vertical direction.

At the top of the piston 42 and fixedly connected thereto is head 40 which gives the piston 42 a T-shaped appearance when viewed in cross section from the rear (as can be seen best in FIG. 4E). The head 40 is a flat, horizontal plate as is more clearly illustrated in FIG. 4D and has a hole 88 in it with the hole being in registry with the axis of the piston 42.

As can be seen from FIGS. 1B, 4B, 4C, and 4E, and particularly FIG. 4C, the piston 42 is in fact a cylinder itself in that it has a hollow core and is open at the bottom. Housed within the hollow core of piston 42 is the vertical actuator mechanism of the present invention. The vertical actuator mechanism is referred to generally by reference numeral 100 (FIG. 4C) and includes hydraulic cylinder 144 (the hollow core of piston 42) and actuator piston 142. Hydraulic fluid is fed into the actuator cylinder 144 at its bottom through nipple 143 which is connected to a source of hydraulic fluid (not shown). The hydraulic fluid is pressurized by a standard pump and hydraulic system. As fluid is pumped into the bottom of the actuator cylinder 144, fluid pressure is applied against the bottom of the actuator piston 142 (the actuator piston 142 being sealed with any well known ring and seal systems to prevent flow of the hydraulic fluid between the piston and cylinder), thus forcing the actuator piston 142 vertically upward to lift the clamp assemblies 20, et al.

As the assembly rises, the top 146 of actuator piston 142 presses against the underside of the head 57 of push pin 54. The push pin 54 is telescopically mounted within sleeve 55 that is in registry with the hole 80 in the head 40. A expansion coil spring 148 is mounted about push pin 54 and seats at its upper most extremity on the bottom face of the sleeve 55 and its lower most extremity on the top face of head 57 of push pin 54. Thus, the spring 148 will, until its resistive strength is overcome by sufficient force, cause the sleeve 55 to move upwardly by transmission of the force from the actuator piston 142 through the head 57 of push pin 54 onto the seat of the sleeve 55. For that reason, push pin 54 and sleeve 55 will move in unison upwardly in the initial stages of the actuation of the system. Upward movement of the sleeve 55 will cause upward movement of the head 40, which in turn causes upward movement of the clamp 46 (as can be seen in FIG. 4E) because clamp 46 is mounted on the head 40. As the assembly continues to rise, clamp 46 will engage the downwardly protruding pinch weld 86 of the car if it is properly aligned side to side or in the "X" direction. Continued application of increased hydraulic pressure will force the actuator piston 142 upwardly, and the weight of the vehicle resting on the clamp 46 will overcome the resistive pressure of spring 148 causing the push pin 54 to move relative to the sleeve 55 and forcing the push pin 54 through the hole 88 in the head 40 of the system. The comparative positions of the push pin 54 can be seen by viewing FIG. 4B which shows the push pin 54 in a retracted position and not protruding out of the hole 88 in the plate 40 whereas, in FIG. 4C, the situation is illustrated when the push pin 54 has moved upwardly relative to the sleeve 55 and engaged the underside of the clamp 46.

As the clamp assemblies 20, et al. are being moved vertically upwardly, the mechanic can be on the perimeter of the platform 18 adjacent the undercarriage of the car and can freely slide the clamps 46 back and forth (in the "X" direction), aligning the clamp 46 on the plate 40 (see FIGS. 1A and 4D) to be directly beneath the pinchweld 86 of the vehicle. The mechanic can be inside the open core 29 of the platform 18 and have one hand on the front and rear clamp assemblies on one side of the vehicle as the clamp assemblies on that side rise, for example, clamp assemblies 22 and 26 shown in FIG. 6, moving them back and forth in the "X" direction to make sure that the mouth of the clamp assembly is directly beneath the pinch weld 86 of the vehicle. Thus, as the clamp assembly 20 continues to rise, the pinchweld 86 of the automobile 80 will be within the mouth 114 of the clamp 46 and properly aligned.

Continued upward movement of the actuator piston 142 will cause the push pin 54 to pass through hole 88 and lock the clamp 46 at the position that the mechanic has located it as he is moving the clamp assemblies back and forth along the plate 40 to get them in proper alignment beneath the pinchweld 86 of the vehicle.

The structure for securing the clamp 46 in a fixed location on plate 40 includes the bracket 48 which has a C-shaped cross section, as is best seen in FIG. 4B, and which has a track 62 throughout its length (see FIG. 4E). The bracket 48 slides over the plate 40 and along the length thereof. The bracket 48 also has an open channel 63 (see FIG. 5) on the underside thereof which enables the bracket 48 to slide along the plate 40 clear of the piston 42 which is connected to the underside of the plate 40. The underside 64 of the C-shaped bracket 48 sits on the upperside 66 of the plate 40 (see FIG. 4B). As additional hydraulic pressure is applied to the system, and as the resistive pressure created by the weight of the automobile overcomes the force of the spring 148, the push pin 54 moves relative to the sleeve 55 and forces the push pin 54 against the underside 64 of the bracket 48, lifting it off of the upper side 66 of the head 40. Prior to the bracket 48 being lifted relative to the head 40, the bracket 48 slides freely along the head 40, and teeth 90 on the upwardly curled lip of the bracket 48 (See FIG. 4B) are separated from the pad 68 on the underside of the head 40. When push pin 54 lifts bracket 48 relative to head 40, teeth 90 come into locked engagement 67 (see FIG. 4C) with pad 68 to eliminate any lateral movement of the bracket 48 relative to the head 40. Continued hydraulic pressure on the push pin 54 will maintain these two elements in locked engagement and will hold the vehicle in place on the platform against any lateral force that may be applied to the vehicle in the alignment process and that may be transmitted through the pinchweld of the vehicle that has been gripped by the jaws of the clamp 46.

The continued hydraulic pressure on push pin 54 will not only hold the bracket 48 in fixed engagement with head 40, but the hydraulic fluid will also seek yet another path of least resistance which, in this case, will serve to force the jaws of the clamp 46 together to grip the pinchweld of the vehicle. Specifically, as can be best seen from FIG. 1A, the damp assemblies, in this case assembly 24, consist of a stationary jaw 110 and a pivoting jaw 112 with a mouth 114 defined by the opposing jaws, the mouth extending vertically in substantial alignment with the pinchweld 86 of the vehicle. The stationary jaw 110 is braced against the bracket 48 by braces 116 which can be welded to the bracket 48 and stationary jaw 110.

The pivoting jaw 112 is pivotally mounted to the side of the bracket 48 via pivot 118 so that the jaw may be pivoted in a retracted, open, at rest position as shown in clamp assembly 24 of FIG. 1A or may be pivoted to the closed, operable position as is shown in FIG. 4D.

Spring 71 is an expansion spring which has sufficient pressure resistive strength to keep the pivoting jaw 112 rotated in the open position as shown in FIG. 1A until such time as the pressure resistive strength of the spring 71 is overcome by the force of the hydraulically operated horizontal piston cylinder mechanism 52. The piston cylinder mechanism 52 includes a cylinder 120 with a piston 122 (see FIG. 1A, clamp assembly 26) mounted against end plate 124 at the outside edge of bracket 48.

When continued pressure is applied to the hydraulic fluid that is used to raise the clamp assemblies and fix the bracket 48 against the head 40, the hydraulic fluid will follow the path of least resistance and pass into the horizontal cylinder 120 and press against the backside of the head of piston 122 forcing the piston 122 out of the cylinder 120, thereby rotating the pivoted jaw 112 into gripping engagement with the stationary jaw 110. In this procedure, the mouth 114 of the clamp 46 is closed, and assuming that the clamp assembly 20, et al. has been properly positioned about the pinchweld 86 of the vehicle, the jaws 110, 112 will close onto the pinchweld 86 and grip the frame of the vehicle to hold it in place during the alignment procedure.

Figure 10:
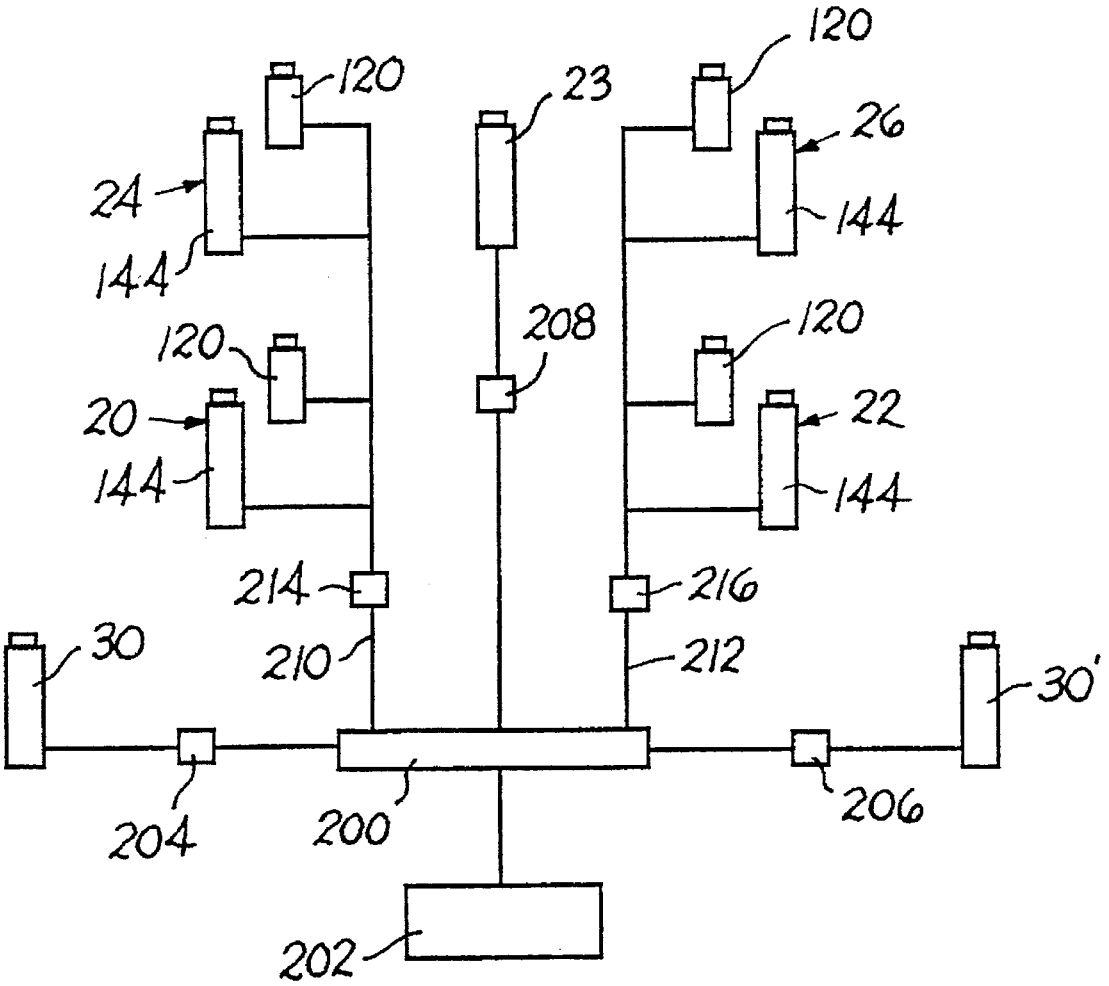
FIG. 10 is a schematic view of the hydraulic system of the present invention.

In the preferred embodiment, as shown in FIG. 10, a single hydraulic line 210 branches off to feed the cylinders 144, 120 on the clamp mechanisms 20, 24 on the right of the device 10, and a single hydraulic line 212 branches off to feed the cylinders of the clamp mechanisms 22, 26 on the left side of the device 10. There is a single valve 214 in the right line 210 and a single valve 216 in the left line 212. As the fluid pressure begins to build up in the hydraulic lines 210, 212, it will first be seen to move the items that exert the least resistance to its force and then, as the fluid pressure increases, it will be sufficient to move the items which exert greater resistance. This has been referred to earlier as "seeking the path of least resistance".

Referring to FIG. 10 and FIGS. 1*a*, 4*b*, and 4*c*, when the fluid pressure first begins to increase in the lines 210, 212, it causes the vertical cylinders 144 to move upwardly toward the vehicle. At this point, the pressure in the lines 210, 212 is not sufficient to move the horizontal pistons 52 against the springs 71 of the clamps 46, as shown on the right side of FIG. 1*a*. The clamping jaws are open, as shown on the right side of FIG. 1*a*, and the clamping brackets 48 are free to be slid manually on the plates 40 to align them with the car frame.

As soon as the vertical pistons 146 encounter the weight of the car, the situation changes. Then, the pressure of the hydraulic fluid in the lines 210, 212 begins to increase. First, it increases to the point that the horizontal pistons 52 in the cylinders 120 overcome the force of their respective clamp springs 71, causing the movable jaws 112 to move, clamping the clamping mechanisms onto the pinchwelds 86 of the car, as shown on the left side of FIG. 1*a*.

Then, the fluid pressure in the lines 210, 212 increases enough for the vertical cylinders 144 to lift the car up, and the car moves upwardly until the alignment rods 49 of the cylinders 144 are stopped by the offset plates 59, as shown in FIG. 4*c*.

Once the alignment rods 49 reach their respective offset plates 59, as shown in FIG. 4*c*, the horizontal plates 40 and sleeves 55 cannot move upwardly any more and begin to exert a strong downward force on their respective vertical springs 148. At this point, the springs 148 collapse, with the pusher pins 54 projecting through their respective holes 88 and lifting the clamping brackets 48 up, causing the teeth 90 on the clamping brackets 48 to push against the respective pads 68 on the bottom of the respective horizontal plates 40, fully locking the respective clamping brackets 48 and horizontal plates 40 together.

Referring now to FIGS. 6, 7, 8 and 9, the features of Applicant's invention relating to the support, raising and retraction of measurement instruments will be described. As can be seen in FIG. 6, rails 128 lie within the open center 29 of the platform 18, substantially parallel to the support surface 28. The rails 128 serve as support structure for the measuring instruments which must be used in conjunction with the alignment procedure. The measuring instruments can be any of several types known and available in the industry, including measuring gauges manufactured by Brewco of and sold under the name FAST TRAK 2000. The measuring instruments sit on rails 128, and can be secured to those rails either fixedly, or in sliding engagement, to be raised into juxtaposition with the unibody at the underframe of the vehicle once the vehicle has been mounted on the platform 18 and clamped by the clamping assemblies 20, et al. as described above. The measuring instruments that sit on the rails 128 must be held in substantially horizontal orientation (the orientation is described as horizontal which is in practically all cases the method of orientation of measuring instruments); however, the instruments can be sitting in a plane other than horizontal so long as they are co-planer with the platform 18 and the desired plane of the pinchweld at the undercarriage of the vehicle.

So that the instruments can be maintained at a horizontal orientation and in essentially flat relationship, regardless of their position on the rails 128, the rails 128 are supported on two parallel roll bars 130 and 132, the front roll bar is designated by numeral 130 and the rear roll bar is designated by number 132. The roll bars 130, 132 are rotatably mounted on their opposite ends to the ends of their respective lifter arms 134, 134', 136 and 136'. At the opposite end of lifter arms 134, 136, the lifter arms 134, 136 are fixedly connected to axles 138 and 140, respectively. Axles 138 and 140 are pivotally connected at their outside ends to the frame of the device 10.

Figure 8:
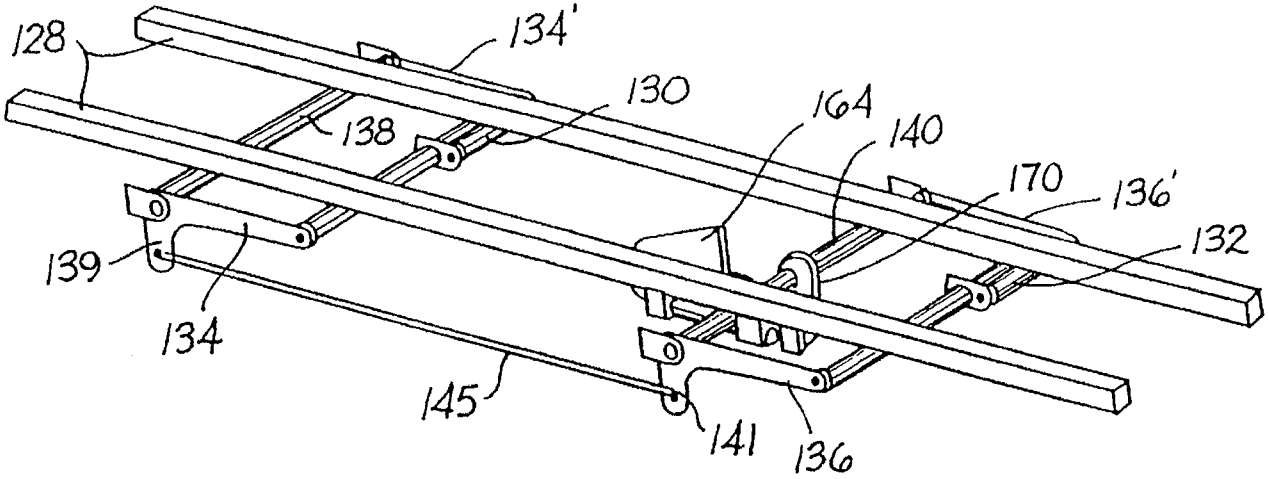
FIG. 8 is a perspective view of the support structure for the instruments and gauges disassociated from the platform itself.
Figure 9:
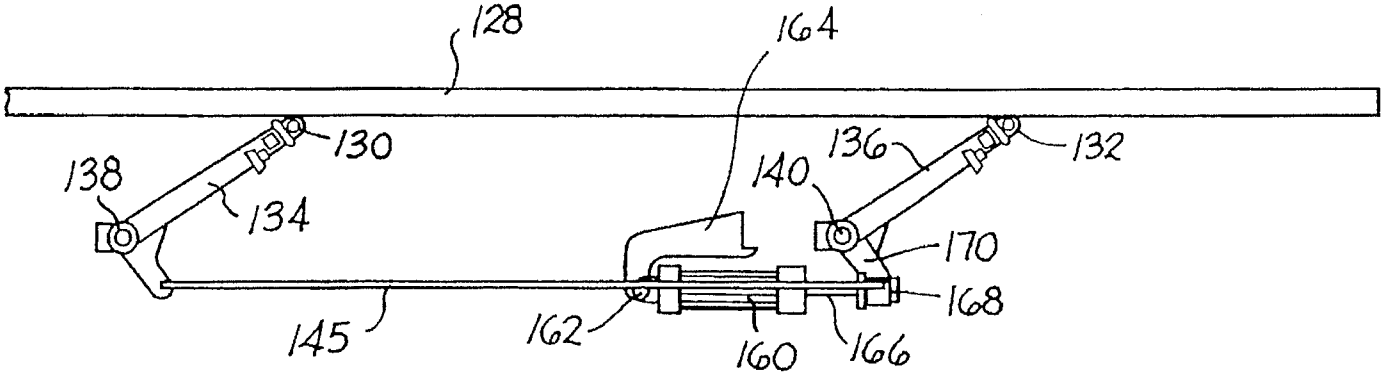
FIG. 9 is another perspective view of the system as shown in FIG. 8 with the support structure rotated to raise the alignment instruments into working position.

Referring to FIG. 9, the lifter arms 134, 136 have depending stubs 139, 141 which are linked by rod 145 (see FIG. 8). A cylinder 160 is pivotally connected at 162 to support bracket 164 beneath the device 10 within the open center 29. The cylinder 160 has a piston 166 within it and as pressure (either hydraulic or otherwise) is applied to the backside of the piston 166, the piston 166 is forced out of the cylinder 160. The end 168 of the piston 166 is pivotally connected to the link 170 (see FIGS. 8 and 9) and the link 170 is fixedly secured to the axle 140. Thus, when the piston 166 extends outwardly from the cylinder 160, the link 170 will rotate in a counterclockwise direction (as viewed from FIGS. 6, 8 and 9) about the axle 140, causing the axle 140 to rotate. When the axle 140 rotates, the arms 136, 136', being fixedly connected to the ends of the axle 140, rotate counterclockwise and thereby shift from a substantially horizontal position to a substantially vertical position (or a 45° angle position as is shown in FIG. 9). Because the arm 136 is connected via rod 145 to arm 134, the arm 134 will likewise be rotated counterclockwise on the rotation of the arm 136 about its pivotal connection to axle 140. The rotation of the arms 134, 134' about the axle 138 into a raised position occur at the same time, speed and rate as the rotation of the arms 136, 136' about the axle 140 will, because the two roller arms 130, 132 are in a slave and master relationship. This movement of the two roller arms 130, 132 causes the rails 128 to be lifted simultaneously and in an even and parallel relationship to place the gauges that are sitting on the rails 128 directly beneath the undercarriage of the car. This entire system is actuated by a switch mechanism to operate the cylinder 160/piston 166 structure through any one of a variety of methods well known in the art. Thus, the mils 128 move from an at rest, inoperative position as shown in FIG. 8 to an activated, operable position as shown in FIG. 9 by the simple process of pressing a button to activate the alignment instrument placement structure. When the alignment procedure is finished, the piston/cylinder arrangement 166/160 is deactivated, allowing the arms 134, 134', and 136, 136' to rotate in a clockwise direction back to the at rest position as shown in FIG. 8.

FIG. 10 illustrates schematically the hydraulic system of the preferred embodiment of the invention. Other alternative hydraulic systems could be employed, but the preferred system is simple and effective. Shown in FIG. 10 is a manifold block 200 which contains a reservoir of hydraulic fluid. A pump 202 is in communication with the manifold block 200 to apply pressure to the hydraulic system. In the preferred embodiment, lines run from the manifold block 200 through valves 204 and 206 to pull towers 30 and 30'. The valves 204, 206 allow a shut off of hydraulic fluid to the pull towers except when a particular pull tower 30 is being used. Likewise, a line is connected to the manifold block which activates the push piston 23 of the tilt system for the platform 18. A valve 208 is in the line between the manifold block and the push piston 23 to control the flow of hydraulic fluid to the push piston 23.

Also connected to the manifold block 200 are lines 210 and 212 which provide hydraulic fluid to the hydraulic cylinders 144 through nipples 143 of each of the clamp assemblies 20, 22, 24 and 26. The actuator mechanisms 100 of assemblies 20, 24 are connected to line 210 and the actuator mechanism 100 of clamp assemblies 22 and 26 are connected to line 212. Thus, the mechanic can operate on one side of the vehicle and have the clamp assemblies 20, 24 at the front and rear of the device 10 being raised in unison until they are properly located by opening the valve 214 in the line 210 and closing the valve 216 in the line 212. Once the clamp assemblies 20, 24 are properly aligned, the valve 216 can be opened thereby providing fluid pressure to the lifting actuator mechanisms 100 of clamp assemblies 22, 26.

In addition to the lifting of the clamp assemblies through the hydraulic pressure as described, the hydraulic fluid will pass to the horizontal cylinder assembly 52, entering cylinder 120 and forcing piston 122 outwardly to cause the pivoting jaw 112 to clamp against the stationary jaw 110. By leaving the valves open, once the system has been properly placed and clamped, the continued operation of the pump will maintain the pressure on the various elements of the system to hold all parts in place without the necessity of pins, bolts, or other ancillary parts while the alignment procedure is being completed through the opening of valves 204, 206 in order to operate pull towers 30, 30' as necessary.

Thus, although there have been described particular embodiments of the present invention of a new and useful device for use in the straightening of the frame of a car, it is not intended that such references be construed as limitations upon the scope of this invention except as set forth in the following claims.

What I claim is:

1. A device for straightening the frame of a vehicle having a pinchweld, said device comprising:

a. a platform for receiving said vehicle, said platform having a open center;

b. a clamp assembly attached to said platform and means for moving said clamp assembly between an at rest position and an engaged position;

c. means for applying a vertical force to said clamp assembly;

d. means for vertically moving said clamp assembly in relation to said platform actuated by said means for applying a vertical force;

e. means for locking said clamp assembly against lateral movement actuated by said means for applying a vertical force; and f. means for damping said clamp assembly to said pinchweld actuated by said means for applying a vertical force.

2. The device of claim 1 wherein said means for applying a vertical force comprises a hydraulically driven piston/cylinder structure.

3. The device of claim 2 wherein said means for vertically moving said clamp assembly in relation to said platform comprises a vertical actuator extended by said hydraulically driven piston/cylinder structure.

4. The device of claim 2 wherein said means for clamping said clamp assembly to said pinchweld comprises a hinged clamp opened and closed by said means for applying a vertical force.

5. The device of claim 1 wherein said means for vertically moving said clamp assembly in relation to said platform comprises a vertical actuator.

6. The device of claim 1 wherein said means for damping said damp assembly to said pinchweld comprises a hinged clamp opened and closed by said means for applying a vertical force.

7. A method for straightening the frame of an automobile having a pinchweld, comprising the steps of:

a. loading the automobile on a platform;

b. activating a hydraulic pressure system to automatically perform the following steps:

i. elevate a clamp assembly vertically proximate the pinchweld with said clamp assembly being freely moveable laterally, during said elevation, from an at rest position to an engaged position horizontally proximate the pinchweld;

ii. lock said clamp assembly against lateral movement prior to applying straightening forces to the frame;

iii. close said elevated clamp assembly over the pinchweld; and c. applying straightening forces to the frame.

8. A device for use in conjunction with the straightening of the frame of an automobile of unibody construction having a pinchweld, said device including:

a. a platform;

b. means for elevating said platform relative to a support surface on which the device is positioned;

c. said platform including two tracks, said tracks lying in substantially parallel relationship in substantially the same plane;

d. said tracks being spaced from each other a distance substantially equal to the distance between the tires on one side of an automobile and the fires on the other side of the automobile;

e. each said track having a width slightly wider than the width of an automobile tire;

f. each said track having a length greater than the distance between the front and rear tires of an automobile;

g. clamp assemblies mounted in conjunction with the platform in such a manner that an automobile clamped by said clamp assemblies will be fixed relative to said platform;

h. elongated rails and each clamp assembly slidably mounted on an elongated rail;

i. the length of each elongated rail being arranged substantially perpendicular to the length of said tracks and lying in a plane parallel to the plane in which the tracks lie;

j. means mounting said elongated rails for movement perpendicular to the planes in which the elongated rail and tracks lie, k. notches formed in said tracks, there being at least as many notches as clamp assemblies of the device, l. the relationship between the clamp assemblies and the notches being such that an elongated rail will pass through a notch upon movement of said elongated rails moving perpendicular to the planes in which the elongated rail and tracks lie; and m. each said clamp assembly slidably positionable along the length of an elongated rail between an at rest position laterally removed from the path of movement of the tires of an automobile traveling along said track and an engaged position at least partially aligned with a notch whereby said clamp assembly can be attached to the pinchweld of an automobile positioned on the platform, even if the point of said attachment is within said path.

9. The device of claim 8 further including means for locking said clamp assemblies against lateral movement along said elongated rails upon vertical movement of the clamp assembly sufficient to cause said clamp assembly to encounter resistance from the weight of an automobile mounted on the platform and the engagement of the clamp assembly with such an automobile.

10. The device of claim 9 wherein the clamp assemblies are automatically activated to grip the pinchweld of an automobile upon the clamp assemblies being locked against lateral movement.

11. The device of claim 10 including a closed loop hydraulic system which activates the vertical movement of the clamp assemblies, the locking of the clamp assemblies against lateral movement and the gripping of the pinchweld of a vehicle by the clamp assemblies.

12. The device of claim 11 wherein the closed loop hydraulic system activates the vertical movement of the clamp assembly, locking of the clamp assemblies and the gripping by the clamp assemblies in series.

13. The device of claim 12 further including means enabling an operator to activate clamp assemblies associated with one of said tracks while deactivating clamp assemblies associated with the other track.

14. The device as claimed in claim 8 further including instrument support means for supporting automobile frame alignment instruments, said instruments supporting means being mounted on said platform between said tracks and means for moving said instrument supporting means between an at rest position below the plane of said tracks and an operable position adjacent the undercarriage of an automobile positioned on said platform.

* * * * *